US006520551B1

(12) United States Patent
Crnkovich

(10) Patent No.: US 6,520,551 B1
(45) Date of Patent: Feb. 18, 2003

(54) OPEN DOOR SECURITY DEVICE

(76) Inventor: Michael V. Crnkovich, 24713 Lois La., Southfield, MI (US) 48075

( * ) Notice: Subject to any disclaimer, the term of this patent is extended or adjusted under 35 U.S.C. 154(b) by 0 days.

(21) Appl. No.: 09/478,288

(22) Filed: Jan. 5, 2000

Related U.S. Application Data

(60) Provisional application No. 60/114,819, filed on Jan. 6, 1999.

(51) Int. Cl.[7] ..... E05C 19/18

(52) U.S. Cl. ..... 292/288; 292/289; 292/292; 70/93; 70/DIG. 49

(58) Field of Search ..... 292/288, 289, 292/292, 295, 263, 266, 269, 277; 70/93, DIG. 49

(56) References Cited

U.S. PATENT DOCUMENTS

| | | | | | |
|---|---|---|---|---|---|
| 1,207,925 | A | * | 12/1916 | Kacenga | 292/288 |
| 2,407,900 | A | * | 9/1946 | Paul | 292/288 |
| 3,620,483 | A | | 11/1971 | Weinberger | |
| 3,924,886 | A | * | 12/1975 | Markovitch | 292/263 |
| 4,208,841 | A | | 6/1980 | Starks | |
| 4,226,453 | A | * | 10/1980 | Robertson | 292/267 |
| 4,257,632 | A | * | 3/1981 | Destepheno | 292/263 |
| 4,630,854 | A | | 12/1986 | Persson et al. | |
| 4,711,479 | A | * | 12/1987 | Grandinetti | 292/529 |
| 5,074,604 | A | | 12/1991 | Merendino et al. | |
| 5,469,139 | A | * | 11/1995 | Ko | 340/545 |
| 5,509,701 | A | | 4/1996 | Reinhard | |
| 5,547,236 | A | * | 8/1996 | Gregory | 292/148 |
| 5,605,365 | A | * | 2/1997 | George | 292/263 |
| 5,865,480 | A | * | 2/1999 | Bain, Jr. et al. | 292/67 |
| 5,899,509 | A | * | 5/1999 | Ferguson et al. | 292/259 R |
| 6,145,351 | A | * | 11/2000 | Levenson | 292/93 |

* cited by examiner

*Primary Examiner*—Anthony Knight
*Assistant Examiner*—Mark Williams
(74) *Attorney, Agent, or Firm*—Bliss McGlynn, P.C.

(57) ABSTRACT

A security device for use in securely fixing the entry path of an enclosure in a predetermined semi-open position includes a first member removably mountable to a structure associated with the entry path to an enclosure and a second member removably mountable to a different structure associated with the entry path to an enclosure and a spacer extending between said first and second members. The security device acts to fix the structures associated with the entry path in a predetermined, spaced position with respect to one another such that the entry path is semi-open to allow access into the enclosure for equipment but which prevents a person from gaining entrance to the enclosure through the entry path.

21 Claims, 5 Drawing Sheets

(FROM PLAN 1) OPTIONAL RADIO CIRCUITRY
80
74
RADIO ALERT INTERFACE (G)
76
82
2 WAY RADIO MODULE (I)
PWR
RADIO ALERT INPUT
MIC INPUT
PTT INPUT
SPEAKER OUTPUT
MIC ELEMENT (J)
86
88
SPEAKER (K)
84
TALK BUTTON (L)
90
RADIO POWER CONTROL MODULE (M)
TALK SENSE
ALERT SENSE
OUT
IN
92
RADIO BATTERY (H)
PROVIDES POWER TO (I)

OPEN DOOR SECURITY DEVICE

BACKGROUND OF THE INVENTION

This application claims the benefit of priority from provisional patent application Serial No. 60/114,819, filed Jan. 6, 1999.

FIELD OF THE INVENTION

The present invention relates, generally, to a security device and, more specifically, to such a device used to securely hold a door or other type of closure in a slightly open or semi-open position to allow limited access through the doorway but at the same time deny human access therethrough.

DESCRIPTION OF THE RELATED ART

The present invention finds particular application in the field of commercial maintenance on buildings and other structures where a closure, such as door, must be held slightly ajar to allow access for equipment. However, from the description that follows, those having ordinary skill in the art will recognize that the invention is in no way limited to such activities and that the present invention may find use for a number of purposes which are now anticipated as well as those that may become apparent in the future.

Thus, by way of example, and not as an exhaustive recitation of its uses, maintenance companies employed, for example to clean carpets and preform other, similar tasks have a particular need for the present invention. Such business entities usually have trucks or vans on which certain equipment is non-removably mounted. Hoses, electrical cords, etc. extend from the truck through an opening in a building, such as a doorway, which is obviously ajar during this process. Accordingly, the building is also unlocked and often unattended.

Carpet cleaning and other maintenance tasks are often performed after regular working hours or on the weekend. Unfortunately, this can result in very unsafe situations. More specifically, this environment presents the opportunity for unauthorized access to the building by unwanted persons, theft and possibly harm to the maintenance and carpet cleaning personnel through the ajar, unattended doorway. This disadvantage limits the effective use of such services in areas of high crime, for banks and other business where cash or other retail goods may be quickly stolen.

Security devices which prevent a door from being fully opened so as to prevent human access into a building are generally disclosed in the related art. However, such devices merely act as barriers for human entry through the opening. Further, the door or other closure device, is normally kept completely shut using the security devices of the related art and are not employed for maintaining the closure in an ajar or semi-open position. Furthermore, the security devices known in the related art are generally not portable and therefore usually require that some part of the device be permanently mounted to some unmoveable structure associated with or adjacent to the opening. Thus, the security devices known in the related art are not suitable for use as portable devices which maintain a closure in a fixed, semi-open or ajar position to allow access through the opening by equipment but which denies human access.

Accordingly, there is a need in the art for a security device which can effectively lock an opening, such as a door or window, in a semi-open or ajar disposition to allow the passage of hoses, electrical cords and other equipment or the like but which otherwise bars entry to the building.

SUMMARY OF THE INVENTION

The present invention overcomes these disadvantages in the related art in an open door security device having a first member removably mountable to a structure associated with an opening to an enclosure and a second member removably mountable to a different structure associated with the opening to an enclosure. The security device also includes a spacer extending between the first and second members. The security device acts to fix the structures associated with the opening in a predetermined, spaced position with respect to one another such that the opening is semi-open to allow access into the enclosure for equipment but which prevents a person from gaining entrance to the enclosure through the opening. In this way, the security device of the present invention allows access past the closure for equipment but does not provide a big enough opening to allow human access through the closure.

More specifically, the security device of the present invention securely holds the door in an ajar or semi-open position which allows access for hoses, electrical cords or other equipment and the like but which does not provide a big enough opening to allow human access. In this way, the maintenance personnel as well as others may go about their business in the building without fear of unauthorized access through the ajar door. The security device is portable. It may be used on a number of buildings and in connection with various types of openings such as doorways, windows or other entrance paths into an enclosure and need not become a fixture of any particular building. In the event of unauthorized tampering, the security device of the present invention may also include audible alert devices which activate to alert authorized personnel of such activity.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE PREFERRED EMBODIMENT(S)

Figure 1:
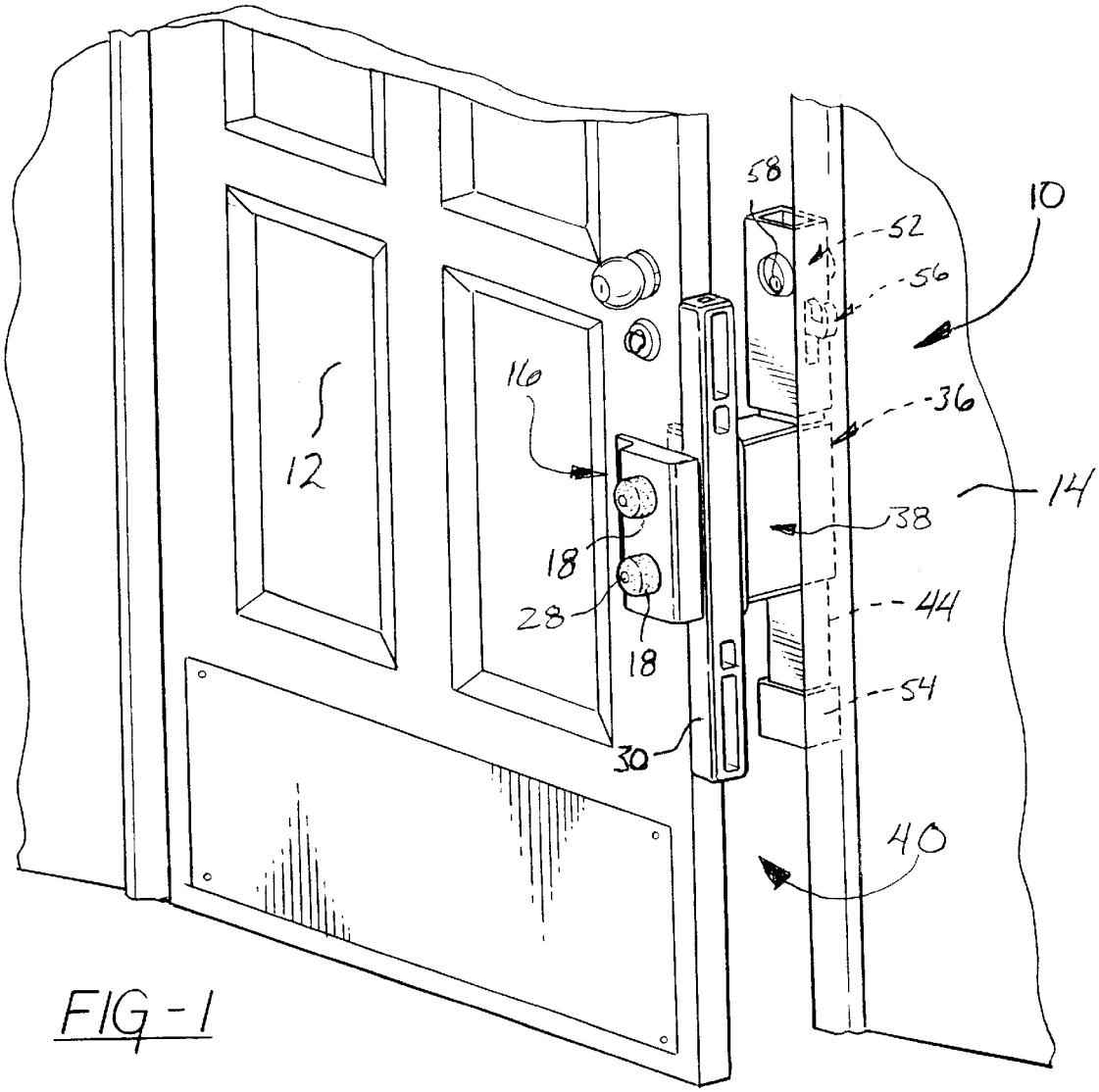
FIG. 1 is a schematic representation of the security device of the present invention shown in one operative environment.

The security device of the present invention is generally indicated at 10 throughout FIGS. 1–4 where like numerals are used to designate like parts. The security device 10 of the present invention may be employed in conjunction with a number of different types of entry paths into an enclosure to allow limited access therethrough for such things as equipment, but at the same time to deny human access through the entry path. In the most common application contemplated by the inventors, the security device may be employed in connection with a doorway in a building of any type. However, those having ordinary skill in the art will appreciate that the present invention may be employed in connection with any suitable entry path into any type of enclosure. For purposes of the preferred embodiment contemplated by the inventor, the security device 10 is shown in FIG. 1 used between a door 12 and a door jamb 14. However, those having ordinary skill in the art will appreciate that the security device 10 may be employed between a pair of doors which are hinged at opposite ends about their respective vertical axes as well as sliding doors which move relative to one another in a common plane. Typically, the security device 10 will be used on commercial grade aluminum, steel or wood doors.

Figure 2:
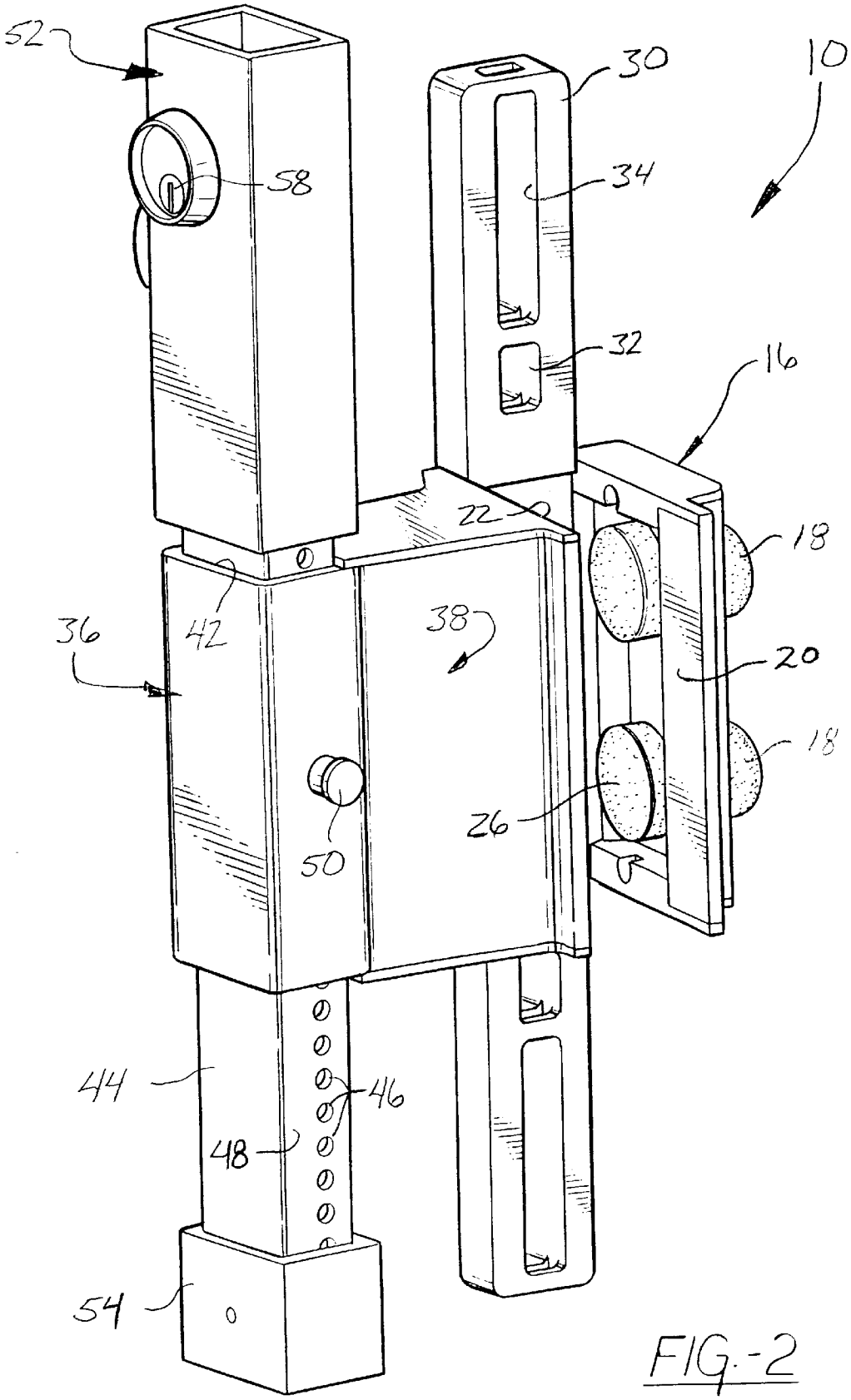
FIG. 2 is a perspective view of one side of the security device of the present invention.
Figure 3:
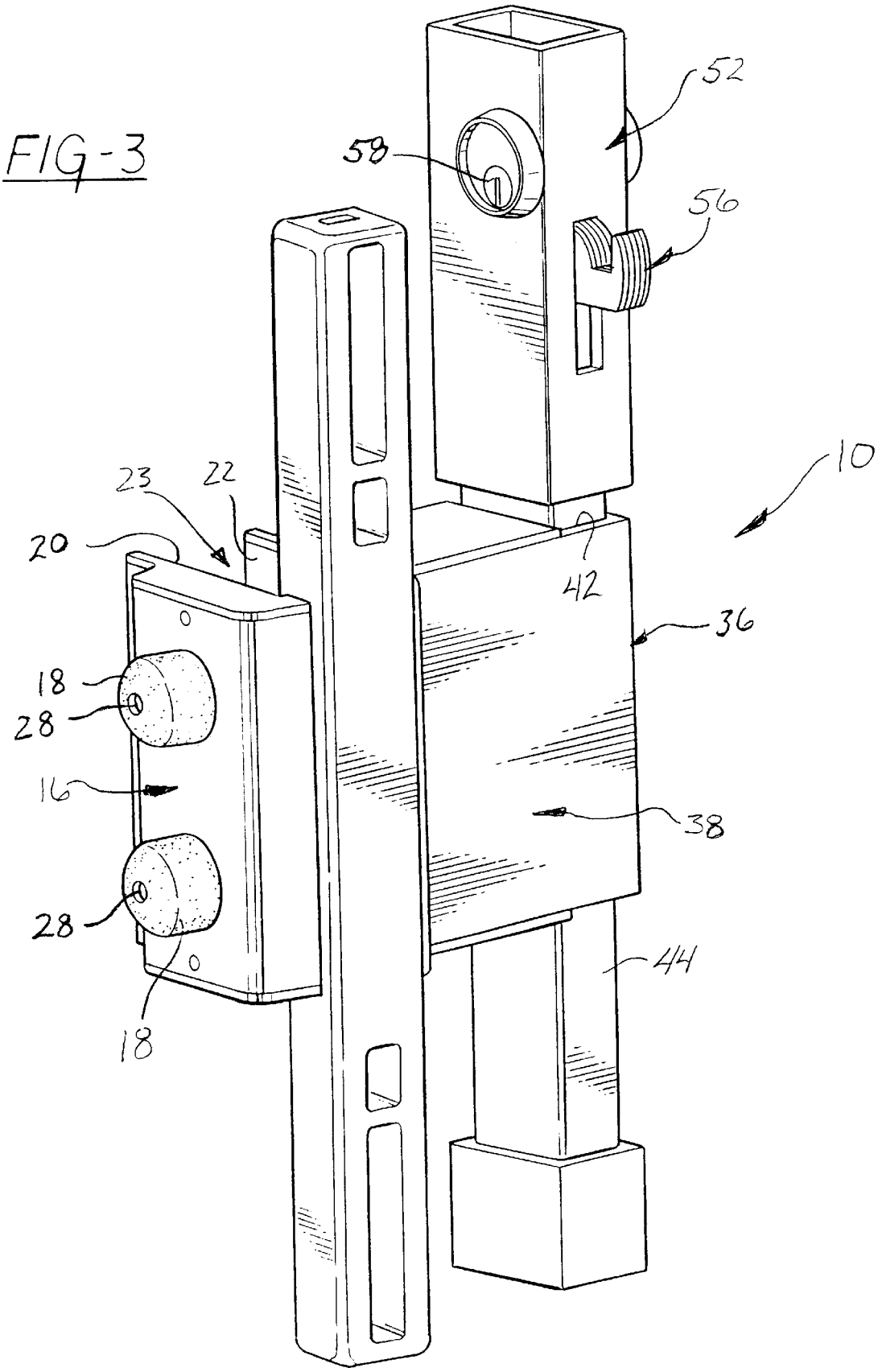
FIG. 3 is a perspective view of the opposite side of the security device shown in FIG. 2.

In any event, as best shown in FIGS. 1 through 3, the security device 10 includes a first member, generally indicated at 16, removably mountable to a structure 12 associated with an entry path to an enclosure and a second member, generally indicated at 36, removably mountable to a different structure 14 associated with the entry path to an enclosure. In addition, the security device includes a spacer, generally indicated at 38, extending between the first and second members 12, 36. The security device 10 acts to fix the structures associated with the entry path in a predetermined, spaced position with respect to one another such that the entry path is semi-open to allow access into the enclosure for equipment but which prevents a person from gaining entrance to the enclosure through the entry path as will be described in greater detail below.

Figure 4:
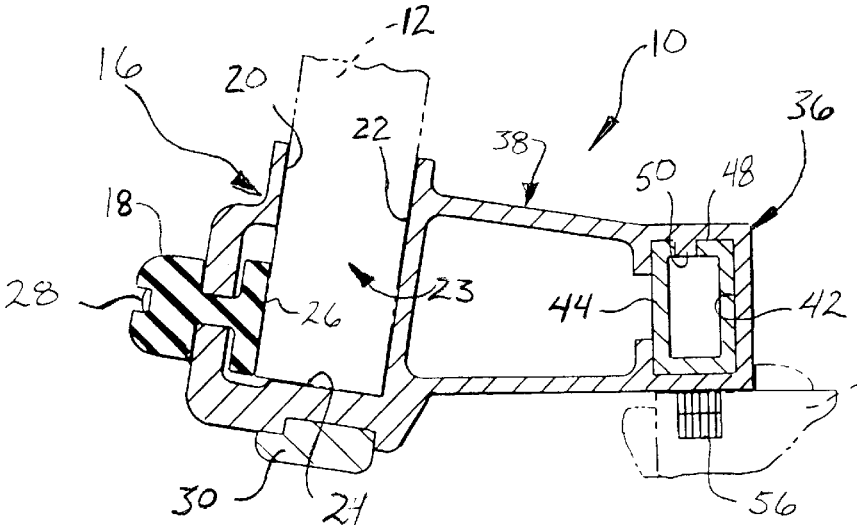
FIG. 4 is a cross-sectional top view of the security device of the present invention.

More specifically and in the preferred embodiment, the first member includes a U-shaped bracket 16 which is removably mounted to a door 12 (FIG. 1) using a plurality of threadably adjustable bumper stops 18 as best shown in FIG. 2. With reference now to FIG. 4, the bracket 16 includes a pair of side walls 20, 22 and a back wall 24 extending between the pair of side walls 20, 22 to define a space 23 within which the associated structure of the entry path may be partially received. The bumper stops 18 are mounted spaced from one another on at least one side wall 20 and present flat gripping surfaces 26. The bumper stops 18 are adjustable toward and away from the other 22 of the pair of side walls and into the space 23 so as to fixedly engage the structure received within the space 23. As illustrated in the Figures, the bumper stops 18 are adapted to engage one side of the door 12 or jamb. However, the bumper stops 18 may also be arranged so that they are accessible from the outside of the building. In either event, once mounted to a door 12, the U-shaped bracket 16 will not be able to be removed by an unauthorized person. To that end, the bumper stops 18 are adjustable only by using a special tool which engages the head of a fastener recessed in the stops 18 as indicated at 28.

A stabilizer, such as a catch bar 30, extends vertically in both directions from the U-shaped bracket 16 and is adapted to be in abutting contact with the associated structure of the entry path along a substantially vertical axis to assist in stabilizing the device 10 relative to a door or jamb. Further, the catch bar 30 may include at least one, but preferably a plurality of special recesses, such as that indicated at 32 and 34 in FIG. 2. The recesses 32, 34 open toward the associated structure of the entry path. The recess 32 may serve as an opening for receiving a standard deadbolt or the like. Similarly, the recess 34 may be adapted to receive a swing door lock or the like. In any event, these recesses 32, 34 act to further stabilize and otherwise fix the bracket 16 to a door or jamb.

On the other hand, the second member may include a housing 36 which is disposed in abutting relation with respect to the opposite structure associated with the entry path, such as the door 14. As noted above, a spacer 38 extends between the bracket 16 and the housing 36 to present an opening 40 between the door or jambs 12, 14 as shown in FIG. 1.

As best shown in FIGS. 2 through 4, the housing 36 defines a channel 42. An indexing arm 44 is adjustably supported for vertical movement in the channel 42 of the housing 36. To that end, the indexing arm 44 includes a plurality of holes 46 on one face 48 thereof. In turn, the housing 36 supports at least one catch 50 which is spring biased to engage at least one of the holes 46. In this way, the indexing arm may be vertically adjustable and fixed relative to the housing 36 by actuating the catch 50 and positioning it within any one of the plurality of holes 46 at any one given time.

Like the catch bar 30 attached to the bracket 16, the indexing arm 44 serves as a brace in abutting contact with the door or jamb to further stabilize the device relative thereto. Together, the bracket 16 and catch bar 30 work to ensure that the security device 10 may not be easily pried out of position or otherwise removed from a doorway or other closure. The indexing arm 44 carries a lock pack 52 at one end thereof. A cap 54 is fixed at the opposite end of the indexing arm 44. By adjusting the position of the arm 44 relative to the housing 36, the lock pack 52 may be positioned relative to a door or jamb such that the locking mechanism generally indicated at 56 is complementarily received within a recess on the door or jamb. The lock pack 52 may be adapted to all types of door locks including, but not limited to, swing latch locks, dead bolts, breaker bar latches as well as any other types of locking mechanism. The lock pack 52 may be operated by a key as indicated at 58.

As illustrated in FIG. 4, the bracket 16, housing 36 and spacer 38 may be manufactured as an integral, one-piece part. As such, the bracket, housing and spacer may be formed of extruded metal such as aluminum or magnesium alloys, heavy duty plastic or any other suitable material. Alternatively, these sub-components may be manufactured of separate pieces which are then fabricated together in any known manner.

Figure 5:
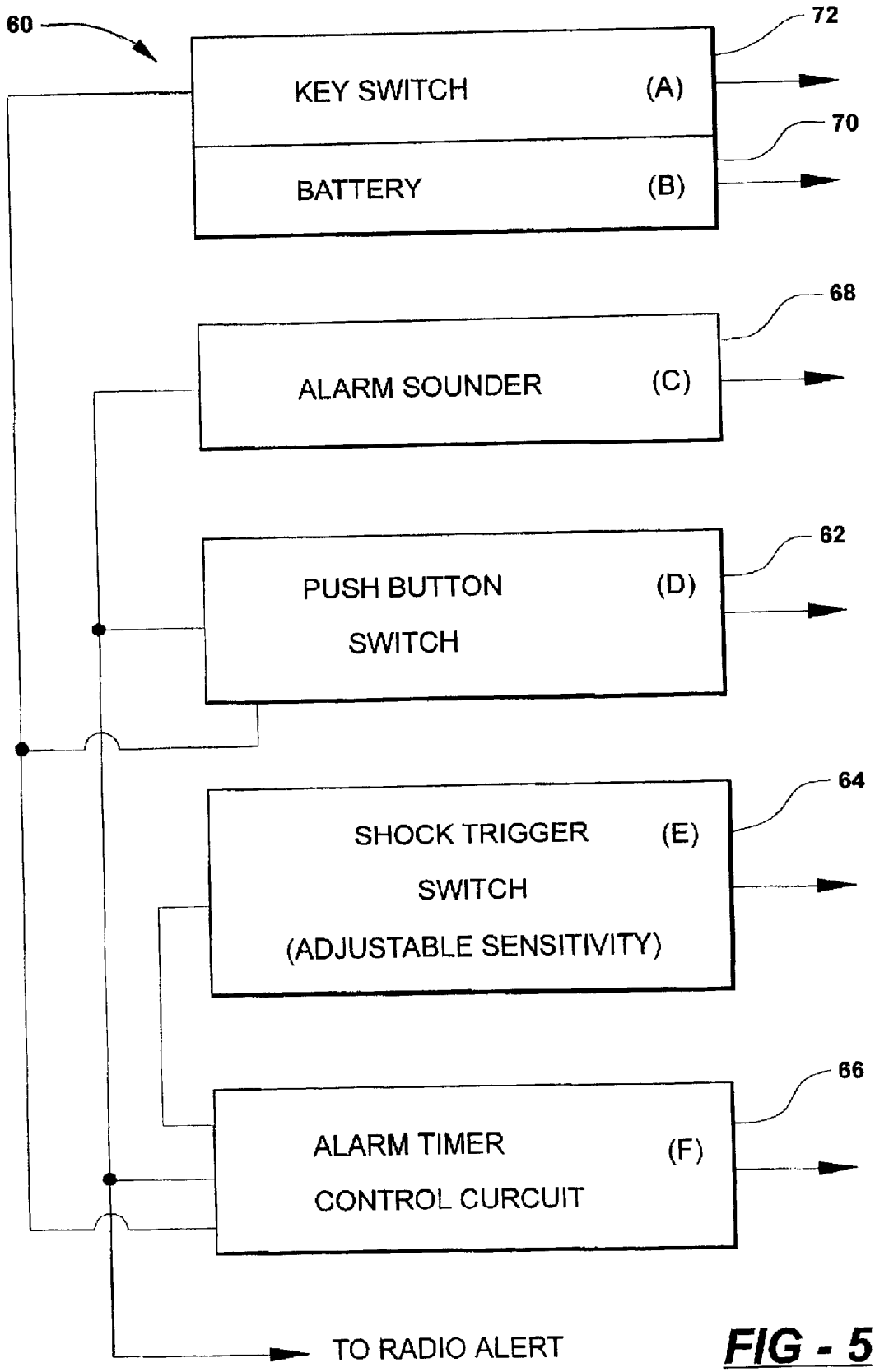
FIG. 5 is a schematic illustrating an audible alert feature of the security device of the present invention.

The security device 10 of the present invention may also include an electronic tamper detection device, as generally indicated at 60 in FIG. 5. The electronic tamper detection device 60 generates a signal as a warning that the security device 10 has been tampered with. As detailed in this figure, the electronic tamper detection device 60 may be used to alert any nearby building occupant with a audible sound made by a variety of audible devices that are attached or otherwise carried in the bracket 16, housing 36 or spacer 38 of the security device 10. More specifically, the alert feature 60 may be activated by a manual push button switch 62 or motion switch 64 which senses unauthorized contact, shock and/or motion. When the switch 64 is activated, a signal is generated which activates an alarm timer control circuit 66. In turn, the control circuit 66 activates an alarm sounder 68 for a predetermined, programmable time period. The electronic tamper detection device 60 includes a source of electrical power, such as a battery, 70 which may be switched on and off by a key switch 72.

Figure 6:
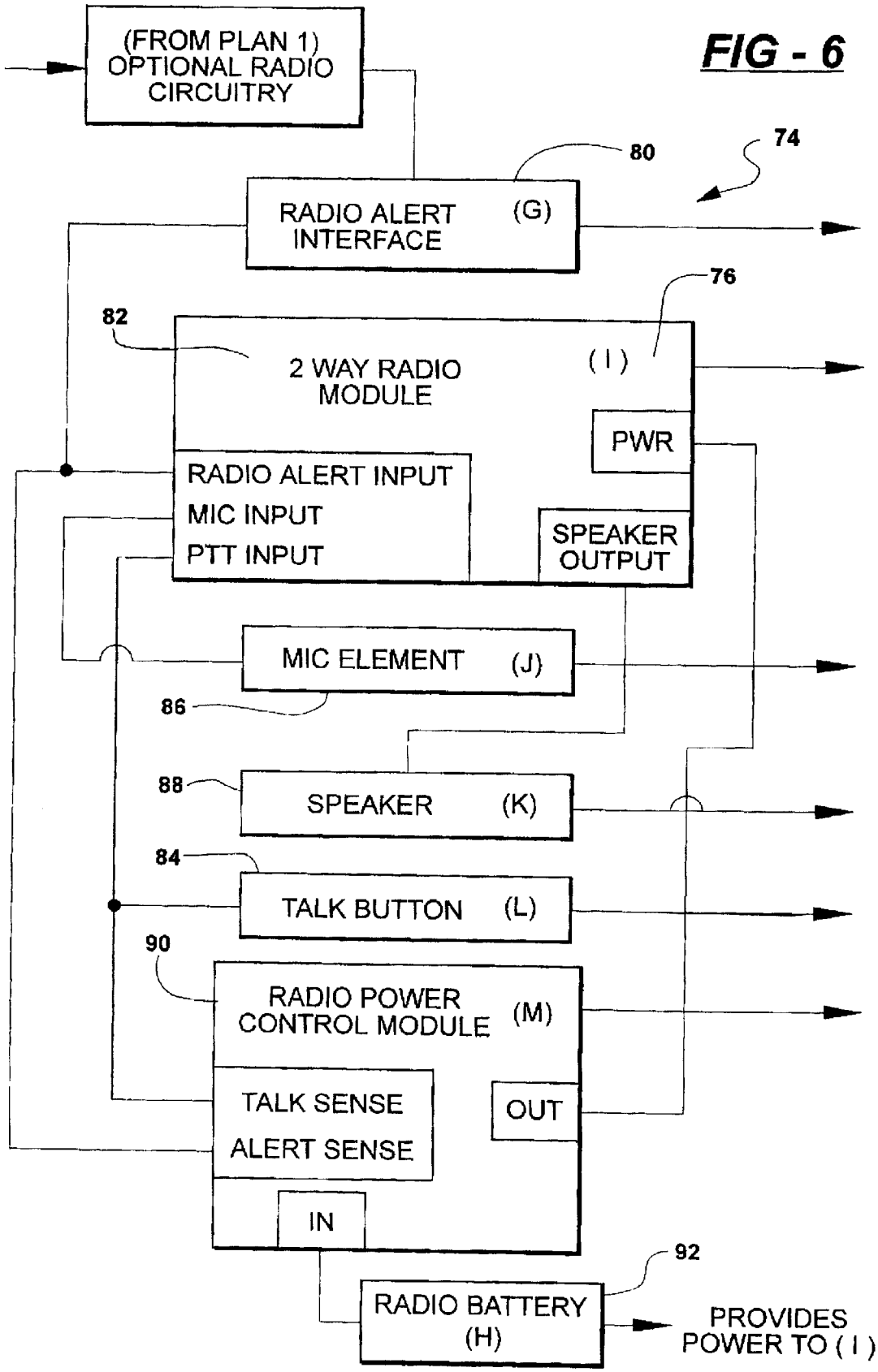
FIG. 6 is a schematic illustrating another embodiment of the audible alert feature of the present invention.

Similarly, the security device 10 may also include additional features as illustrated by the audible alert device 74 shown in FIG. 6. In addition, the audible alert device 74 may be optionally interfaced with the electronic tamper detection device 60 illustrated in FIG. 5. The audible alert device 74 may be activated to generate a radio signal as will be described in greater detail below. To this end, the audible alert device includes a radio transceiver 76 that provides remote alerting and intercom functions. The alert function is activated by switches 62 or 64 illustrated in FIG. 5 via a radio alert interface 80. The alert function sends a signal over the radio waves using two-way radio module 82 whenever the alarm sounder 68 shown in FIG. 5 is activated. This signal results in a tone or sound emitted by the receiver of the two way radio module 82. Furthermore, the present invention may include an intercom consisting of a two-way radio voice function which may be activated when the talk button 84 is depressed. A mike element 86 may also be employed to receive voice commands. When the talk button 84 is released, return audible instructions may be received by the two-way radio module 82 from a remote radio. A speaker 88 is employed for this purpose. A radio power control module 90 receives power from radio battery 92 and supplies it to the two-way radio module 82 for a programmable period of time whenever the two-way radio module 82 is activated either manually by the talk button 84 or by the radio alert interface 80. Further, a timer is reset whenever the transmitter of the two-way radio module is employed. The radio power control module 90 will interrupt power to the radio transmitter 82 after a programmable time period has expired. This feature will greatly improve the life of the battery 92.

Once positioned and placed as illustrated in FIG. 1, the security device 10 securely holds the door 14 in an ajar or semi-open position which allows access for hoses, electrical cords, other equipment and the like, provides ventilation of the internal area, but which does not provide a big enough opening 40 to allow human access. In this way, the carpet cleaning or maintenance personnel as well as others may go about their business in the building without fear of unauthorized access through the ajar door. The security device 10 is portable. It may be used on a number of buildings, doorways or other closures and need not become a fixture of any particular building. In the event of unauthorized tampering, the audible alert devices 60 and 74 will activate to alert authorized personnel of such activity.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What I claim is:

1. A portable security device for use in securely fixing the entry path of an enclosure in a predetermined semi-open position, said security device comprising:

a first member including a bracket removably mountable to a structure associated with an entry path to the enclosure and a second member removably mountable to a different structure associated with the entry path to the enclosure and a spacer extending between said first and second members so as to separate said first and second members by a fixed predetermined distance and wherein said first member, said second member and said spacer define an integrated assembly, said second member including an arm that is operatively adapted to engage the other structure associated with the entry path therewith so as to removably fix said security device relative to the associated structure of the entry path, said security device acting to fix the structures associated with the entry path in a predetermined, spaced position with respect to one another such that the entry path is fixed in a semi-open position to allow access into the enclosure for equipment but which prevents a person from gaining entrance to the enclosure through the entry path.

2. A security device as set forth in claim 1 wherein said bracket has a U-shape having a pair of side walls and a back wall extending between said pair of side walls to define a space within which the associated structure of the entry path may be partially received.

3. A security device as set forth in claim 2 wherein said first member includes a plurality of stops mounted on at least one of said pair of side walls, said stops being adjustable toward and away from the other of said pair of side walls and into said space so as to fixedly engage the structure received within said space.

4. A security device as set forth in claim 2 wherein said bracket includes a stabilizer extending vertically from, and above and below said back wall, said stabilizer adapted to be in abutting contact with the associated structure of the entry path along a substantially vertical axis.

5. A security device as set forth in claim 4 wherein said stabilizer includes at least one recess opening toward the-associated structure of the entry path and which is adapted to receive a portion of a locking mechanism extending from the structure.

6. A security device as set forth in claim 5 wherein said stabilizer includes a plurality of said recesses opening toward the associated structure of the entry path and wherein at least one of said plurality of recesses is adapted to receive a dead bolt extending from and associated with the structure.

7. A security device as set forth in claim 2 wherein said second member includes a housing which defines a channel, said indexing arm is adjustably supported for vertical movement in said channel, said indexing arm operatively adapted to engage the other structure associated with the entry path in abutting contact therewith so as to stabilize said security device relative to the associated structure of the entry path.

8. A security device as set forth in claim 7 wherein said indexing arm includes a lock pack having a locking mechanism which is adapted to be complementarily received within a recess on the associated structure of the entry path.

9. A security device as set forth in claim 7 wherein said indexing arm includes a plurality of holes on one face thereof, said housing including at least one catch which is operable to engage at least one of said holes at any one given time to fix the position of said indexing arm relative to said housing.

10. A security device as set forth in claim 9 wherein said catch is biased in the direction of said plurality of holes in said indexing arm to effect positive engagement therewith.

11. A security device as set forth in claim 1 wherein said bracket, housing and spacer are an integral, one piece part formed of an extruded material.

12. A security device as set forth in claim 1 wherein said device includes an electronic tamper detection device which generates a signal as a warning that said device has been tampered with.

13. A security device as set forth in claim 12 wherein said electronic tamper detection device includes a switch which senses unauthorized contact with said device and generates said signal which activates an alarm in response to the unauthorized contact.

14. A security device as set forth in claim 13 wherein said alarm is audible at said security device.

15. A security device as set forth in claim 13 further including a receiver remote from said electronic tamper detection device wherein said alarm signal is electronically transmitted to said receiver and then audibly sounded at said receiver.

16. A security device as set forth in claim 13 wherein said electronic tamper detection device includes an alarm timer control circuit for activating said alarm for a predetermined period of time.

17. A security device as set forth in claim 13 wherein said switch is manually actuated at said security device to sound an audible alarm.

18. A security device as set forth in claim 13 wherein said electronic tamper detection device includes a source of electrical power.

19. A security device as set forth in claim 13 wherein said electronic tamper detection device includes a two way radio having a transmitter and a receiver which are adapted to send and receive signals therebetween.

20. A security device as set forth in claim 19 wherein said transmitter includes a speaker mounted to said security device and said receiver includes a microphone receiver mounted to said security device.

21. A security device as set forth in claim 19 wherein said security device includes a manually actuated switch actuates said microphone at said device.

* * * * *